235-412 SR
PTH31 XR 4,253,249

United States Patent [19] [11] 4,253,249
Ashford et al. [45] Mar. 3, 1981

[54] WEAPON TRAINING SYSTEMS

[75] Inventors: David W. Ashford, Farnborough; William B. Davies, Hook; Sydney S. Hartley, Bath, all of England

[73] Assignee: The Solartron Electronic Group Limited, Farnborough, England

[21] Appl. No.: 73,418

[22] Filed: Sep. 7, 1979

[30] Foreign Application Priority Data

Sep. 13, 1978 [GB] United Kingdom ..... 36657/78

[51] Int. Cl.[3] ..... F41G 3/26
[52] U.S. Cl. ..... 434/22
[58] Field of Search ..... 35/25; 273/310; 235/404, 405, 407, 411, 412, 413, 414, 415, 416, 417; 364/423, 516, 801

[56] References Cited

U.S. PATENT DOCUMENTS

| | | | |
|---|---|---|---|
| 3,143,811 | 8/1964 | Tucci et al. | 35/25 |
| 3,243,896 | 4/1966 | Immarco et al. | 35/25 |
| 3,588,108 | 6/1971 | Ormiston | 35/25 X |
| 3,877,157 | 4/1975 | Ashford et al. | 35/25 |
| 3,882,496 | 5/1975 | Lewis et al. | 35/25 X |

FOREIGN PATENT DOCUMENTS

| | | | |
|---|---|---|---|
| 2153895 | 5/1973 | Fed. Rep. of Germany | 35/25 |
| 1115141 | 5/1968 | United Kingdom | 35/25 |
| 1228143 | 4/1971 | United Kingdom | 35/25 |
| 1228144 | 4/1971 | United Kingdom | 35/25 |
| 1298332 | 4/1971 | United Kingdom | 35/25 |
| 1451192 | 9/1976 | United Kingdom | 35/25 |

*Primary Examiner*—William H. Grieb
*Attorney, Agent, or Firm*—Joseph J. Kaliko; Mikio Ishimaru; Dale V. Gaudier

[57] ABSTRACT

The effects of any errors in the preliminary tracking of a target, and of any subsequent changes in the velocity of the target, are included in simulated firing of a gun 3, by slewing a laser projector 2 in the simulator for the predicted shell time-of-flight at the rate assessed during the preliminary tracking and then scanning with the laser for hit/miss determination. The slewing is achieved either by having the gun control system slew at the required rate, or by having the gunner continue tracking the target, corrections for deviations from the required rate being automatically applied to the projector.

6 Claims, 6 Drawing Figures

FIG. 1
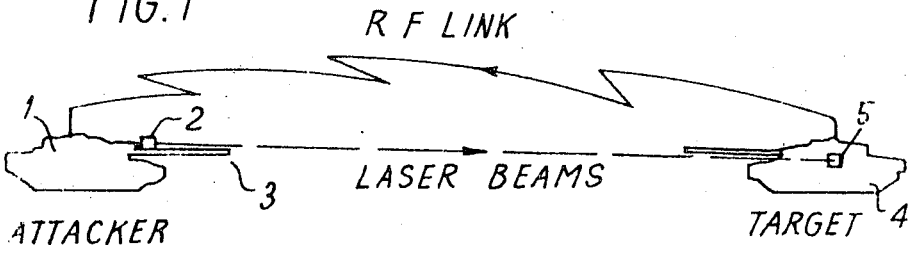
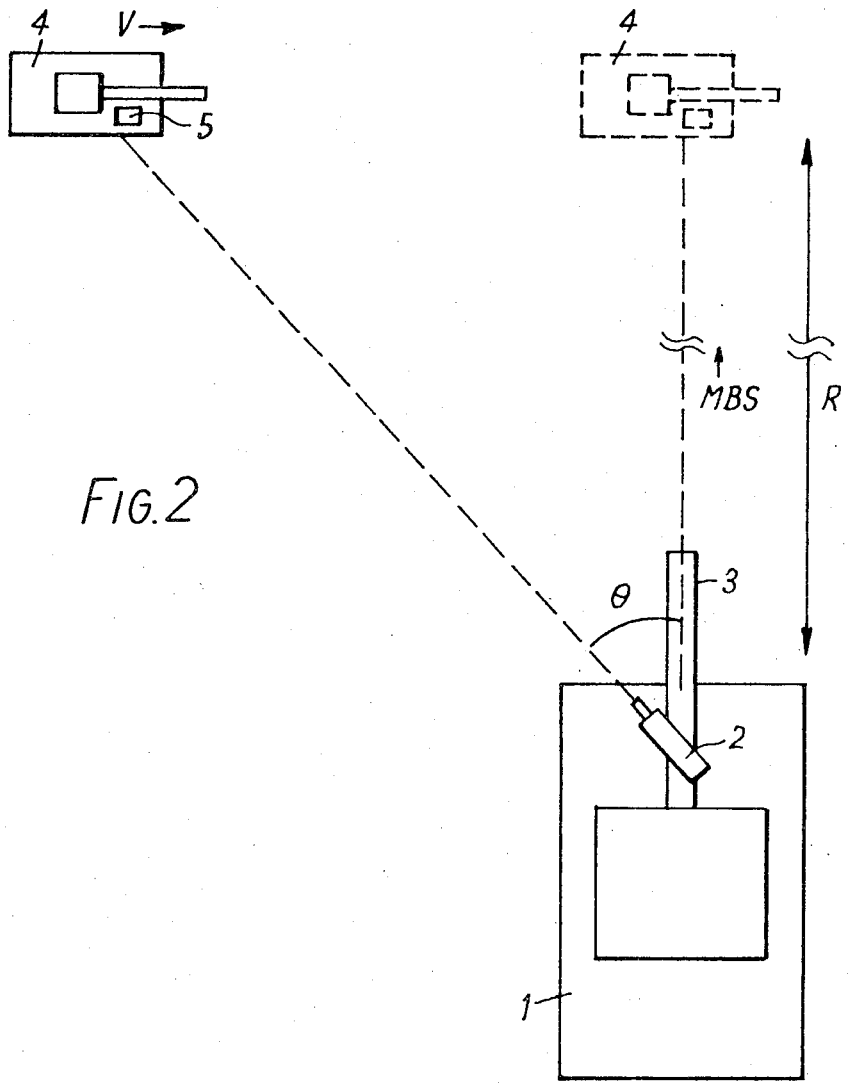
FIG. 2

WEAPON TRAINING SYSTEMS

This invention relates to weapon training systems, and particularly to systems for assessing the accuracy of aim of a weapon at a target when there is relative movement between the weapon and the target.

Weapon training systems for assessing accuracy of aim and simulating the effects of firing guns at targets are well known, and are described, for example, in our British Pat. Nos. 1,228,143, 1,228,144 and 1,451,192. It is also well known that, in aiming a weapon at a moving target, allowance must be made for the combined effect of the finite time of flight of the ammunition and any relative motion in azimuth of the weapon and the target. The systems described in the above mentioned specifications include simple facilities whereby the accuracy with which such allowance (known as 'aim-off' or 'lead-angle') is included can be tested.

However, such known systems only cater for aim-off based on instantaneous assessments of target motion.

Current weapon design and operation, for example in a tank, involves ranging of a moving target, and then tracking of the target by the gunner so that the rate of motion of the target can be measured by a fire control system in the tank. The fire control system then calculates the required offsets in the position of the gun in the tank, that is the elevation appropriate to the range, and the aim-off required to compensate for the measured rate of target motion. The calculated elevation and aim-off are applied to the gun which is then fired. Known weapon training systems cannot test the accuracy of tracking of the target by the gunner, nor do they provide for the possibility that the target may change its direction and/or speed of motion during the time of flight of the ammunition.

According to one aspect of this invention a weapon training system for assessing the accuracy of aim of a weapon at a target, when there is relative movement between the weapon and the target and the target is tracked for a period to measure its rate of motion relative to the weapon, comprises source means associated with the weapon to provide a beam of electromagnetic radiation, detector means for detecting when the beam is incident on the target, means for deriving a signal indicative of the range of the target from the transit time of electromagnetic radiation between the source means and the detector means, means for calculating from the range signal the time of flight of ammunition that would be fired by the weapon, steering means responsive to signals indicative of weapon offsets derived from the range signal and the measured rate of motion of the target and arranged to move the direction of the beam such that, at the end of the calculated time of flight, the beam direction has been subjected to a net deflection by an amount equal and opposite to said offsets plus the product of the measured rate of motion of the target and the calculated time of flight, and means for energising the source means at the end of the calculated time of flight to assess the accuracy of aim.

As previously mentioned, the weapon offsets will generally be calculated by a fire control system for the weapon. If the weapon includes equipment for accurately measuring range, the range signal may be treated as having been derived by this equipment (as described in the aforementioned U.S. Pat. No. 1,451,192), so the offset derived from the range signal would also be applied to the weapon itself. However, if such rangefinder equipment is not included in the weapon, or is to be treated as inoperative to provide practice in manual estimation of range, the offset actually applied to the weapon (and derived from the manually estimated range) would not necessarily equal the (accurate) offset to which the steering means is responsive.

In one embodiment of the invention, the steering means is provided with a signal indicative of the said measured rate of motion of the target and with another signal indicative of the actual motion of the weapon during the calculated time of flight, and is arranged to move the direction of the beam relative to the weapon to compensate for any deviations in the motion of the weapon from the measured rate of motion. Alternatively, if the weapon includes a facility for automatically traversing the weapon at the said measured rate of motion, the steering means may be arranged to activate this facility for the calculated time of flight while itself deflecting the beam direction by an amount equal and opposite to the offsets derived from the range signal. In either case, by delaying the energisation of the source means until the end of the calculated time of flight, and deflecting the beam direction as appropriate during that time, it is possible to check the accuracy of the preliminary measurement of the rate of motion of the target; also, if the target should change its direction and/or speed of movement in a manner that would avoid a hit in a real firing, the training system will accurately simulate the resulting miss.

According to another aspect of this invention there is provided a method of assessing the accuracy of aim of a weapon at a target, when there is relative movement between the weapon and the target and the target is tracked for a period to measure its rate of motion relative to the weapon, comprising the steps of deriving a signal indicative of the range of the target from the transit time of electromagnetic radiation between source means associated with the weapon to provide a beam of such radiation and detector means for detecting when the beam is incident on the target, calculating from the range signal the time of flight of ammunition that would be fired by the weapon, moving the direction of the beam such that, at the end of the calculated time of flight, the beam direction has been subjected to a net deflection by an amount equal and opposite to weapon offsets derived from the range signal and the measured rate of motion of the target, plus the product of the measured rate of motion of the target and the calculated time of flight, and energising the source means at the end of the calculated time of flight to assess the accuracy of aim.

A weapon training system and a method in accordance with this invention will now be described, by way of example, with reference to the accompanying drawings, in which:

FIG. 1 depicts an attacking tank and a target tank;

FIG. 2 shows the aim-off required when the target tank is moving;

Figure 4:
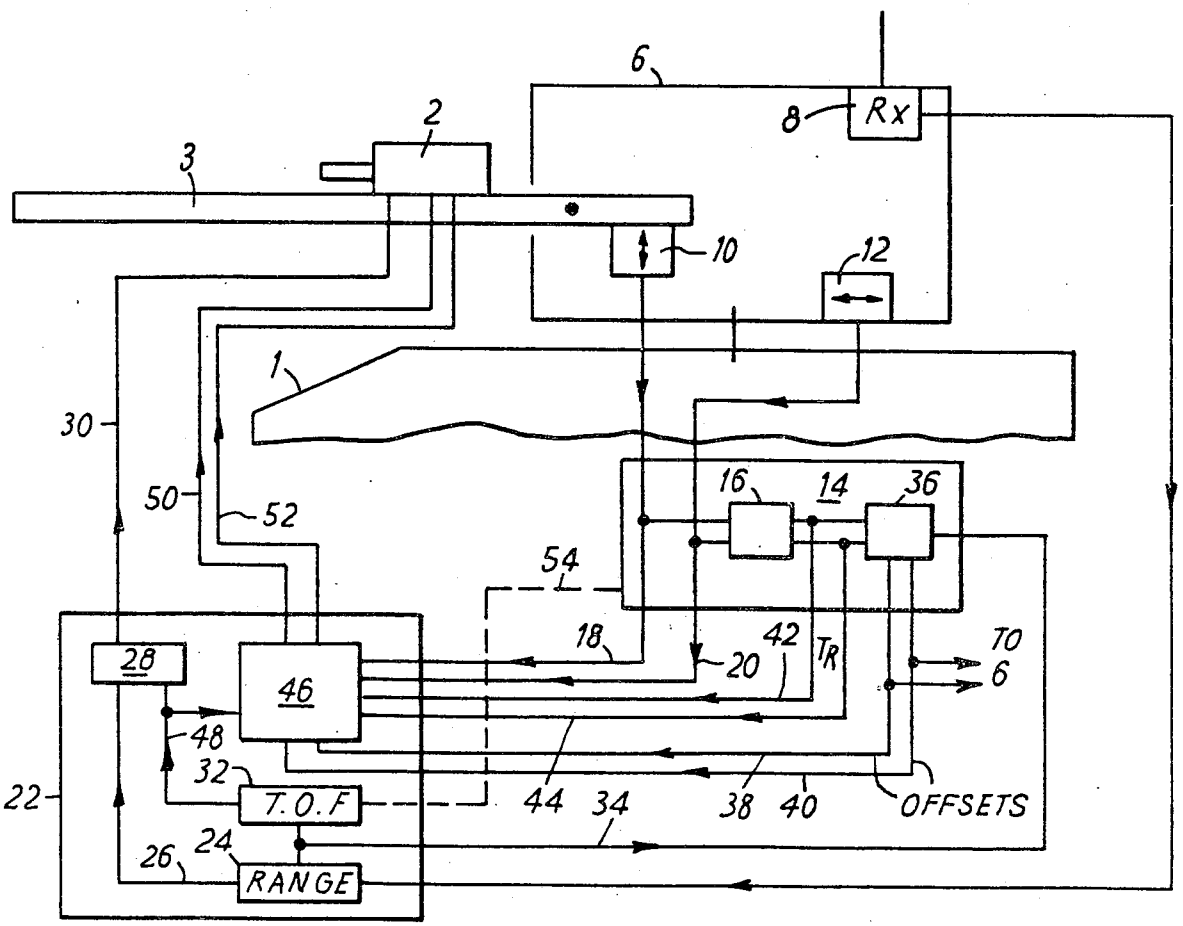
FIG. 4 is a block schematic diagram of the weapon training system.
Figure 5:
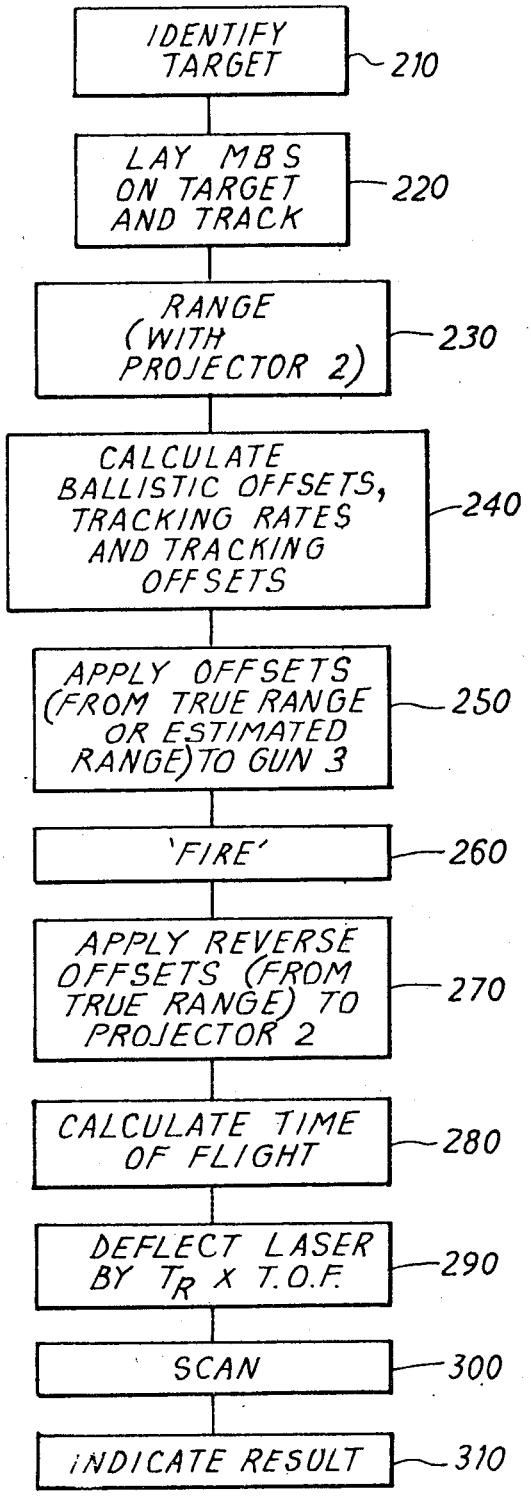
Figure 6:
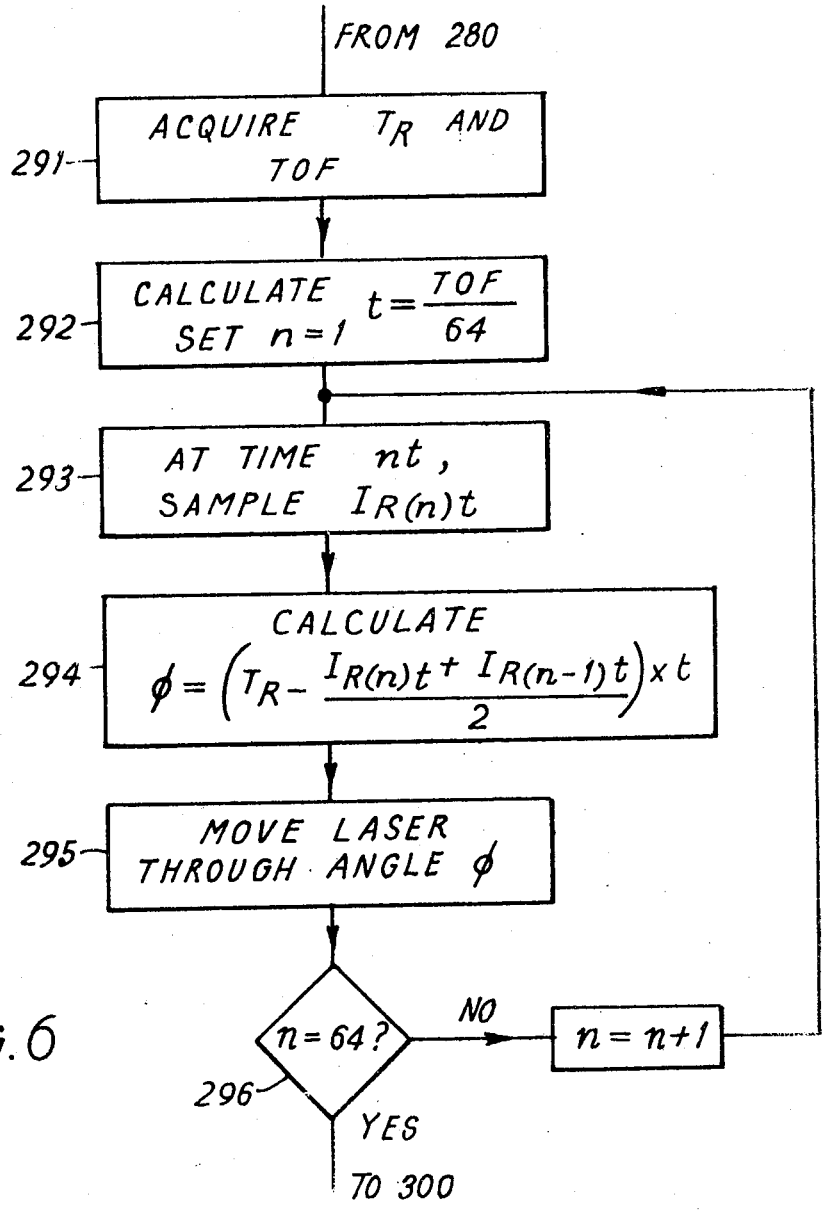

FIG. 5 of a flow diagram illustrating the method of operation of the system shown in FIG. 4; and FIG. 6 is a flow diagram illustrating in more detail a step in the flow diagram of FIG. 5.

The system and method to be described are for use in training tank crews in firing procedures without the expense and danger of firing live ammunition. As shown in FIG. 1, an attacking tank 1, with a projector 2 mounted on a main gun 3, is engaging a target tank 4 carrying a detector 5. Simulated firing of the main gun 3 causes a pulsed beam or beams of radiation from a laser source within the projector 2 to scan in relation to the axis of the main gun 3, to detect a 'hit' or a 'miss'. When a beam impinges on the detector 5, a signal is transmitted by an r.f. transmitter in the target tank 4 to a receiver in the attacking tank 1.

In practice, of course, the main gun 3 of the tank 1 must be elevated in accordance with the range of the tank 4. To test the accuracy with which the gun 3 is elevated, the systems described in British Pat. Nos. 1,228,143, 1,228,144 and 1,451,192 provide for the range to be determined from the aggregated transit times of the laser pulses and r.f. signals, so that the projector 2 can be depressed through the angle appropriate to that range relative to the main gun 3. Thus, if the main gun 3 is correctly elevated, that is to that angle, the projector 2 will be directed at the target tank 4 again, so its pulses can activate the detector 5. The above-identified specifications also describe in detail circuits for measuring transit time (and thus range) mounting and steering arrangements for the projector 2, and circuitry for controlling the pulsing, orientation and scanning of the beam or beams of radiation from the laser source: these circuits and arrangements are suitable for use in the present invention, and therefore need not be described in detail herein.

The systems described in the above-mentioned specifications also provide simple facilities for including aim-off in their operation.

Referring now to FIG. 2, the target tank 4 is now shown moving in azimuth in relation to the attacking tank 1. In view of the finite time taken for a shell fired by the main gun 3 to traverse the range R, it is necessary for the main boresight MBS to be aimed ahead of the target tank 4 by an aim-off or lead-angle $\theta$ dependent on the crossing speed V in azimuth of the target tank 4. In the known systems, the projector 2 is deflected relative to the main gun 3 by the same angle $\theta$, so that the detector 5 will only receive pulses from the projector 2 if the main gun 3 is aimed ahead of the target tank 4 by the correct aim-off at the instant of 'firing'. However, the deflection $\theta$ applied to the projector 2 is derived either from a value of the target speed V manually preset into the training system, or from measurements of the speed V at the instant of 'firing'. Consequently, the known systems merely test the ability of the tank crew to aim accurately, taking account of aim-off, at the instant of 'firing', without regard to earlier or later events.

Figure 3:
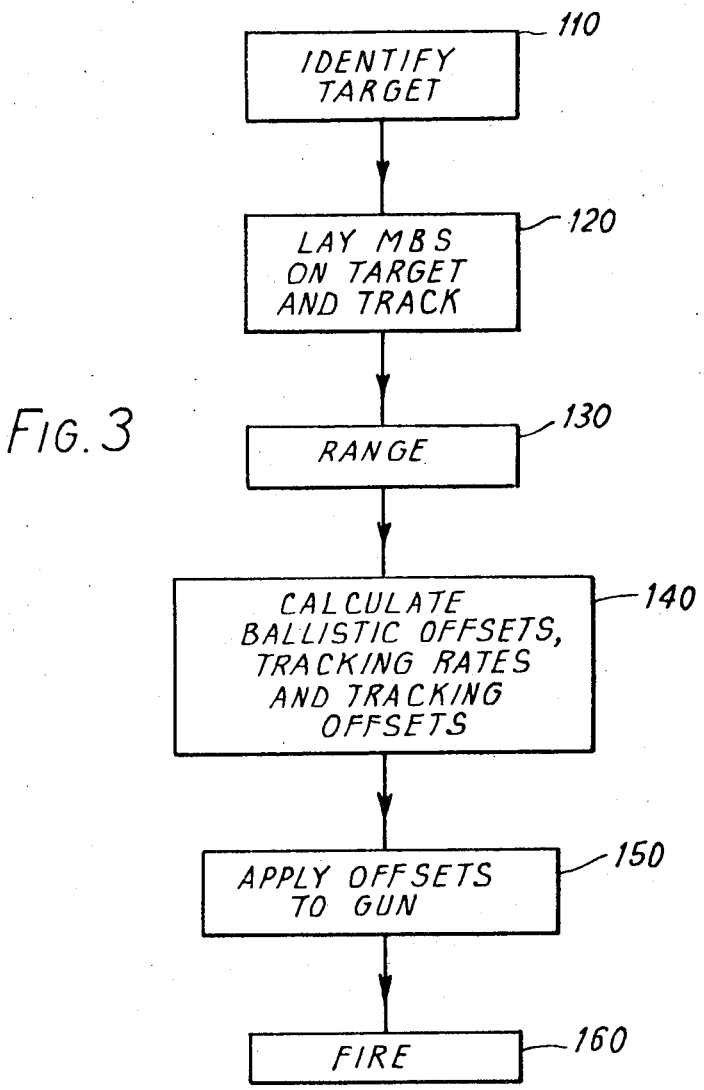
FIG. 3 is a flow diagram illustrating the operations involved in aiming the gun of the attacking tank.

FIG. 3 is a flow diagram illustrating the typical sequence of actions during a battle engagement by the crew and equipment of a tank having a fire control system. After the tank commander has identified a target, as indicated at 110, the gunner lays the main boresight on the target—step 120—and tracks the target (that is, controls the movement of the tank turret to maintain the main boresight on the target). The range of the target is obtained, for example with a laser rangefinger, at step 130, this data being supplied to the fire control system along with information about the movement of the turret obtained by tachometers or rate gyros.

The fire control system calculates the ballistic offsets for the gun (primarily in elevation, with a possible subsidiary azimuth component) from the range, and from such information as windspeed obtained from appropriate sensors (not shown) on the tank; the fire control system also calculates from the information on turret movement the overall tracking rates for the target, and from these the corresponding tracking offsets (primarily in azimuth, with a possible subsidiary elevation component). These operations are indicated at step 140.

Up to this point, the gun has been slewed to track the target using the main boresight. Now, information corresponding to the total required offsets (ballistic offsets plus tracking offsets) is supplied to the gunner, for example by deflection of an aiming mark from the main boresight mark, under the control of the fire control system. The slewing of the gun is now altered sufficiently to introduce these offsets (elevation and aim-off) into the aiming of the gun—step 150. When the gunner is satisfied, for example, by reference to the positions of the aiming mark and the target, that the gun is correctly laid (that is, slewing to track the target with the appropriate elevation and aim-off) he fires the gun—160.

In some cases, the fire control system may be arranged to slew the gun automatically to track the target, at the rates calculated in step 140, after the offsets have been introduced in step 150. Furthermore, the range of the target can generally be entered into the fire control system manually, to cater for the possibility of an inoperative rangefinder.

A system in accordance with this invention, for use in simulating the procedures outlined in FIG. 3, is shown in FIG. 4.

Referring to FIG. 4, the tank 1 has a turret 6 carrying the main gun 3 and the r.f. receiver, referenced 8, mentioned above. The projector 2 is, as noted previously, mounted on the main gun 3, which also carries a rate sensor 10 for sensing changes in elevation of the gun 3. Another rate sensor 12 in the turret 6 senses movements in azimuth.

The signals from the rate sensors 10 and 12 are supplied to the fire control system 14, where they are processed as indicated at 16, to derive the calculated overall tracking rates $T_R$ of the target. The signals from the rate sensors 10 and 12 are also supplied, on lines 18 and 20, to a computer 22 which co-ordinates operation of the weapon training system.

To this end, the computer 22 contains a program of instructions for carrying out appropriate calculations and logical decisions to derive signals required to operate the projector 2. The computer 22 may be digital, with the program of instructions stored in digital form therein; alternatively, it may be analogue, with the program implemented in the form of appropriate circuitry for carrying out each successive step. For convenience and clarity of description, the latter configuration will be assumed.

The computer 22 includes a range circuit 24 arranged to trigger, via a line 26, a laser control circuit 28 which in turn energises the laser in the projection 2 via a line 30. As described in the specifications referred to earlier, measurement of the elapsed time between emission of a laser pulse and receipt of a corresponding r.f. signal from the target tank 4 (FIG. 1) by the receiver 8 enable the circuit 24 to derive a signal indicative of the range of the target tank 4. This range signal is supplied to a time-of-flight circuit 32 in the computer 22 and, via a line 34, to the fire control system 14.

Within the fire control system 14, the range signal is processed as indicated at 36, together with the calculated tracking rates $T_R$ and signals from various sensors (not shown), to derive the appropriate offsets in elevation and azimuth. These offsets are supplied to the gunsight in the turret, and also on lines 38 and 40 to the computer 22. The computer 22 receives in addition the calculated tracking rates $T_R$ on lines 42 and 44.

The signals on the lines 38 to 44 are supplied within the computer 22 to a steering control circuit 46 which also receives the rate gyroscope signals on the lines 18 and 20.

The time-of-flight circuit 32 calculates (for example, from a look-up table) the time of flight of the ammunition in the gun 3, from the range and the characteristics of the ammunition, and supplies a signal indicative of the estimated time of flight on a line 48 to the laser control circuit 28 and the steering control circuit 46.

The steering control circuit 46 is responsive to its various input signals to control the orientation of the laser beam in elevation and azimuth by means of signals supplied to the projector 2 on lines 50 and 52.

The operation of the system shown in FIG. 4 will now be described, with reference in addition to the flow diagram shown in FIG. 5.

After the tank commander has identified a target (step 210) and the gunner has laid the main boresight on the target (220), the range of the target is obtained. Where a laser rangefinder is fitted, the computer 22 may be arranged to inhibit its operation, the laser in the projector 2 being energised instead. The orientation of the laser beam is arranged initially to be aligned with the bore of the gun 3, so the detector 5 on the target tank 4 (FIG. 1) will receive the laser beam and return an r.f. signal, enabling the range circuit 24 to derive the range (step 230). This range is used together with the calculated tracking rates $T_R$ by the fire control system 14 to calculate the appropriate offsets (step 240), which are supplied to the computer 22 on the lines 38 and 40.

As noted above, these offsets would normally also be supplied to the gunsight to indicate to the gunner the necessary changes in the slewing of the gun 3 (step 250). However, if the laser rangefinder is deemed inoperative (to provide practice in manual rangefinding), the manually estimated range would be entered into the fire control system 14 via a control panel, and the system 14 would calculate a second set of offsets from this range for supply to the gunsight and aiming of the gun 3 at step 250. Since the laser in the projector 2 is, as noted above, supplied with offset signals derived from the range measured accurately by the computer 22, the accuracy of the manually estimated range is checked via its effects on the accuracy of aim of the gun 3.

When the gunner is satisfied with the aiming of the gun 3, he 'fires' (step 260), whereupon the computer 22 causes the offsets received on the lines 38 and 40 to be applied to the orientation of the laser beam of the projector 2 by the steering control circuit 46, in the reverse sense to that in which they were (or would be) applied to the gun 3 (step 270). At the same time, the time-of-flight circuit 32 calculates the time of flight of the ammunition (step 280).

As will be described in more detail hereinafter, the steering control circuit 46 then deflects the orientation of the laser beam of the projector 2 by an amount equal to the product of the calculated tracking rates $T_R$ and the calculated time of flight (step 290). This amount is equal to the angle $\theta$ in the case of FIG. 2. Thus, when the computer 22 causes the projector 2 to scan the laser beam to test the accuracy of aim (step 300), a hit will be indicated at step 310 (by virtue of the detector 5 on the target tank 4 receiving the laser radiation) only if the tracking rate $T_R$ and the range have been correctly estimated, the appropriate offsets have been accurately applied to the gun 3 and the target tank 4 has not changed its direction and/or speed of movement after the offsets were calculated.

If, for example, the tracking rate is over-estimated, the aim-off will be too great, so the turret 6 (and the projector 2) will be directed too far ahead of the target tank 4. At the time of 'firing', the reverse offset will be applied to the projector 2, which will then start by pointing at the target tank 4; but by the end of the calculated time of flight the orientation of the projector 2 will have moved ahead of the target tank 4, and a miss will be registered. If, on the other hand, the initial tracking of the target tank 4 is correct, but the aim-off is over-applied, the projector 2 will start by pointing ahead of the target tank 4 at the time of 'firing', and will remain in that condition, so a miss will again be registered.

FIG. 6 shows in flow chart form a procedure for deflecting the orientation of the laser beam in dependence upon each of the calculated tracking rates $T_R$ and the calculated time of flight, as required in step 290 above.

Referring to FIG. 6, at step 291 the calculated tracking rate $T_R$ (either in elevation or in azimuth) on the line 42 or 44 and the calculated time of flight TOF are acquired (by the steering control circuit 46). The time TOF is divided by 64 at step 292 to derive a sampling time interval t. After n intervals t have elapsed, the circuit 46 samples the appropriate rate sensor signal on the line 18 or the line 20 to obtain the instantaneous rate $I_{R(n)t}$-293. At step 294 this rate is averaged with the previously-sampled instantaneous rate $I_{R(n-1)t}$, the average is subtracted from the calculated rate $T_R$, and the difference multiplied by the sampling interval t to obtain a correction factor $\phi$. This factor is applied by the circuit 46 to correct the elevation or azimuth as appropriate of the orientation of the laser beam, at step 295. Thus, by the end of the calculated time of flight, as detected at step 296, the deflection of the orientation of the laser beam has been corrected 64 times for departures from the calculated tracking rates $T_R$, and the overall tracking rates of the laser beam orientation equal the calculated rates $T_R$. The magnitude of the corrections can be minimised, if desired, by instructing the gunner to continue tracking the target tank 4 after 'firing'.

As mentioned earlier, the fire control system 14 may be arranged to slew the gun 3 automatically at the calculated tracking rates $T_R$ after the offsets have been applied, and before firing. In such a case, it may be possible to activate this facility after firing, by a suitable signal supplied to the fire control system 14 from the computer 22, whereupon the gun 3, and the projector 2 as a whole, will be deflected at the calculated tracking rates $T_R$ as desired, rendering unnecessary any deflection of the orientation of the laser beam by the steering control circuit 46 after the reverse offsets have been applied. Thus, the lines 18, 20, 42 and 44 in FIG. 4 may be omitted, and replaced by a line 54 to supply an appropriate activating signal, derived from the circuit 32, to the fire control system 14 for the duration of the calculated time of flight.

Although the system described above has the detector 5 mounted on the target 4, as shown in FIG. 1, it is to be understood that the invention is equally applicable to systems in which the detector 5 is carried with the projector 2 by the attacker 1, radiation incident upon the target 4 being returned to the detector 5 by a retro-reflector carried by the target 4.

We claim:

1. A weapon training system for assessing the accuracy of aim of a weapon at a target, when there is relative movement between the weapon and the target and the target is tracked for a period to measure its rate of motion relative to the weapon, comprising:

source means associated with the weapon to provide a beam of electromagnetic radiation;

detector means for detecting when the beam is incident on the target;

means for deriving a signal indicative of the range of the target from the transit time of electromagnetic radiation between the source means and the detector means;

means for calculating from the range signal the time of flight of ammunition that would be fired by the weapon;

steering means responsive to signals indicative of weapon offsets derived from the range signal and the measured rate of motion of the target and arranged to move the direction of the beam such that, at the end of the calculated time of flight, the beam direction has been subjected to a net deflection by an amount equal and opposite to said offsets plus the product of the measured rate of motion of the target and the calculated time of flight; and means for energising said source means at the end of the calculated time of flight to assess the accuracy of aim.

2. A system according to claim 1, wherein the steering means is provided with a signal indicative of the said measured rate of motion of the target and with another signal indicative of the actual motion of the weapon during the calculated time of flight, and is arranged to move the direction of the beam relative to the weapon to compensate for any deviations in the motion of the weapon from the measured rate of motion.

3. A system according to claim 1, wherein the weapon includes a facility for automatically traversing the weapon at the said measured rate of motion, and the steering means is arranged to activate this facility for the calculated time of flight while itself deflecting the beam direction by an amount equal and opposite to the offsets derived from the range signal.

4. A method of assessing the accuracy of aim of a weapon at a target, when there is relative movement between the weapon and the target and the target is tracked for a period to measure its rate of motion relative to the weapon, comprising the steps of deriving a signal indicative of the range of the target from the transit time of electromagnetic radiation between source means associated with the weapon to provide a beam of such radiation and detector means for detecting when the beam is incident on the target;

calculating from the range signal the time of flight of ammunition that would be fired by the weapon;

moving the direction of the beam such that, at the end of the calculated time of flight, the beam direction has been subjected to a net deflection by an amount equal and opposite to weapon offsets derived from the range signal and the measured rate of motion of the target plus the product of the measured rate of motion of the target and the calculated time of flight; and energising said source means at the end of the calculated time of flight to assess the accuracy of aim.

5. A method according to claim 4, wherein the beam is moved relative to the weapon to compensate for any deviations in the motion of the weapon from the measured rate of motion.

6. A method according to claim 4, wherein the weapon includes a facility for automatically traversing the weapon at the said measured rate of motion, and including the step of activating this facility for the calculated time of flight while deflecting the beam direction by an amount equal and opposite to the offsets derived from the range signal.

* * * * *